US005974962A

United States Patent [19]

Hamu et al.

[11] Patent Number: 5,974,962

[45] **Date of Patent: *Nov. 2, 1999**

[54] REGISTRATION SYSTEM FOR WORK SUPPORT PALLETS AND SCREEN FRAMES OF PRINTING MACHINES

[75] Inventors: Kaino J. Hamu, 16061 Dominica Cir., Huntington Beach, Calif. 92649; Alan J. Hamu, Sunset Beach, Calif.

[73] Assignee: Kaino J. Hamu, Huntington Beach, Calif.

[ * ] Notice: This patent is subject to a terminal disclaimer.

[21] Appl. No.: 09/153,573

[22] Filed: Sep. 15, 1998

[51] Int. Cl.[6] ..... B41F 15/16

[52] U.S. Cl. ..... 101/126; 101/127.1; 101/DIG. 36; 101/129

[58] Field of Search ..... 101/127.1, 126, 101/DIG. 36, 113, 115, 129

[56] References Cited

U.S. PATENT DOCUMENTS

| | | | |
|---|---|---|---|
| 4,520,726 | 6/1985 | Rouly et al. | 101/123 |
| 4,669,378 | 6/1987 | Lee | 101/115 |
| 5,107,758 | 4/1992 | Withers | 101/35 |
| 5,161,460 | 11/1992 | Anderson et al. | 101/116 |
| 5,226,362 | 7/1993 | Iaccino et al. | 101/129 |
| 5,503,068 | 4/1996 | Newman | 101/126 |
| 5,613,436 | 3/1997 | Taylor | 101/115 |
| 5,694,845 | 12/1997 | Newman | 101/126 |

*Primary Examiner*—Edgar Burr
*Assistant Examiner*—Dave A. Ghatt
*Attorney, Agent, or Firm*—Boniard I. Brown

[57] ABSTRACT

A system for registering a work support pallet on a carousel machine arm with a screen frame of the machine has pivot components on a pallet tool and on the arm for detachable pivotable mounting of the pallet tool relative to the arm for accurate pivotal movement of the pallet tool into proximity with the screen frame.

9 Claims, 2 Drawing Sheets

REGISTRATION SYSTEM FOR WORK SUPPORT PALLETS AND SCREEN FRAMES OF PRINTING MACHINES

BACKGROUND AND SUMMARY OF THE INVENTION

The present invention is utilized with carousel printing machines, such a machine comprising a plurality of print stations with stationary screen frames spaced circumferentially about the machine, and arms with work support pallets thereon rotatable into positions under successive stationary screen frames for printing a plurality of registering images on a workpiece on each work support pallet. Such machines are shown and described in U.S. Pat. No. 5,226,362 to Iaccino, et al., and in U.S. Pat. No. 5,806,422 to Alan Hamu.

A work support pallet must be in registration with respective screen frames at successive screen print stations spaced from the center of the machine in a generally circular arrangement. It has usually been required that work support pallets be removed and later re-mounted on machine arms in the process of alignment of work support pallets with screen frames.

A support pallet is removed, replaced with an alignment pallet, or pallet tool, then re-mounted and secured on the machine arm after registration with a screen frame. Time, labor and expense are involved in bolting the work support pallet, aligning the pallet tool, utilizing the alignment pallet for alignment with a screen frame, and removing and remounting the work support pallet on the arm.

The present invention provides the advantages of a pallet tool being quickly and conveniently installable and removable relative to a machine support arm, simplifying alignment of work support pallets with screen frames, and disassembly of work support pallets from the arms. Removal of the support pallet from the arm and later reassembly on the arm, after registration, are eliminated.

According to the present invention, a pallet tool is supported on a machine arm by engagement of a wedge member on the pallet tool in a groove member on the arm for pivotal movement of the pallet tool to a position beneath the screen frame. The pallet tool is a relatively rigid structure to provide rigidity and accuracy of alignment relative to a machine arm tool. With the work support pallet accurately registered relative to the machine arm, independently of the pallet tool, the pallet tool is moved into position in underlying relation with the work support pallet, the pallet tool maintaining alignment relative to the arm. Registration means, such as mutually engaging registration pins and openings, register the pallet tool with the screen frame.

The arrangement of the present invention is particularly useful where there is inadequate clearance or access above the machine arm.

U.S. Pat. No. 5,832,822 of Kaino J. Hamu, relates to a system wherein a pallet tool is pivotally accurately moved into position for registration with a work support pallet by the pallet tool pivoting above a machine arm and work support pallet. This application is incorporated herein by reference.

DESCRIPTION OF THE PREFERRED EMBODIMENT

Figure 1:
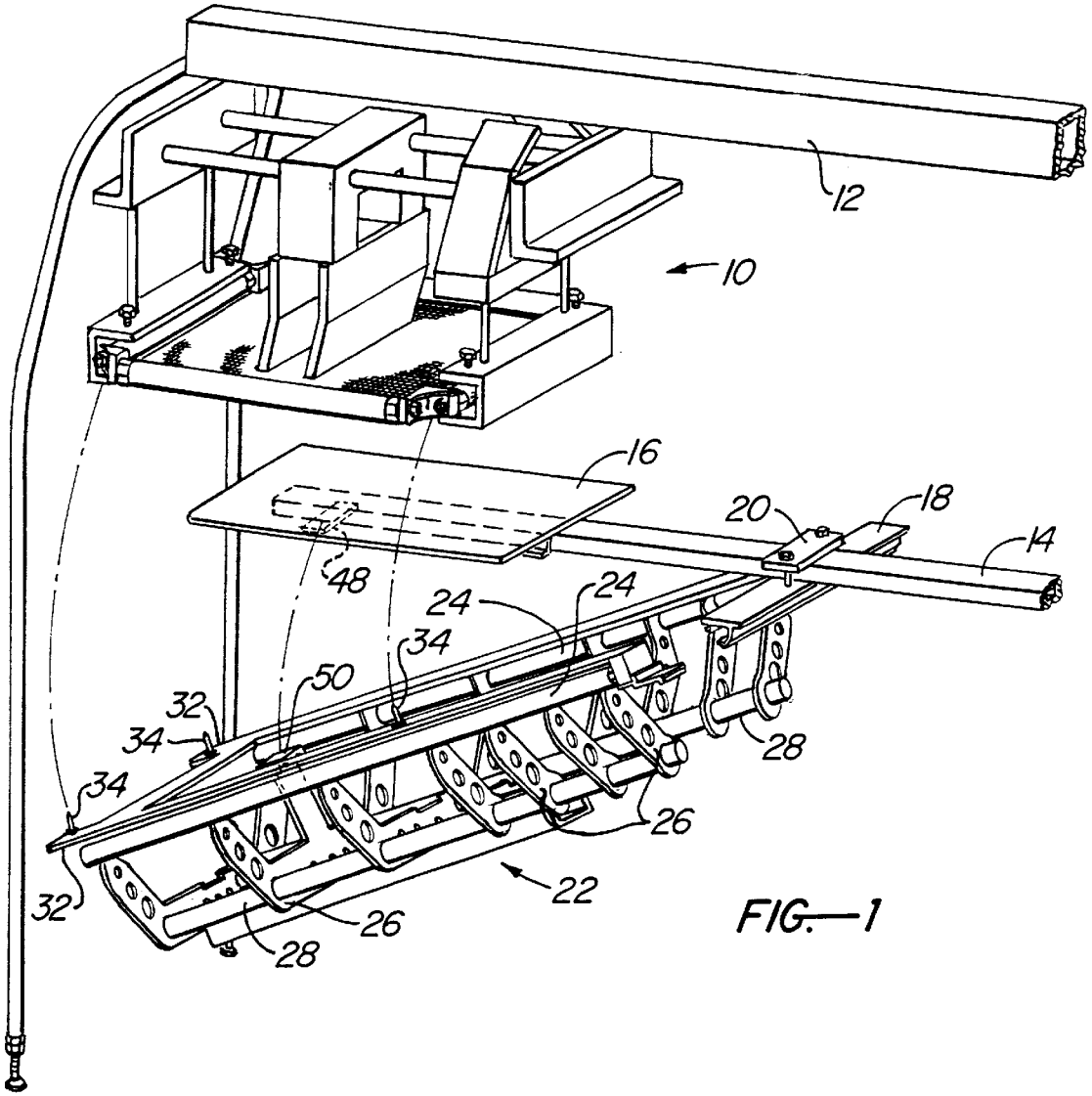
FIG. 1 is a perspective view of registration apparatus according to the invention, including a bracket on a machine arm defining a groove, and a pallet tool having a wedge engaging the groove for detachably pivotally mounting the pallet tool relative to the arm.

Referring to the drawings, FIG. 1 shows a screen frame assembly 10 supported on a beam 12 which extends from a carousel printing machine (not shown). The screen frame is supported from the beam by conventional structure secured to the beam as by welding and fasteners, and the end of the beam is supported by vertically extending legs, as shown. An arm 14 extends from the carousel machine, being one of a plurality of arms extending radially from the machine.

A work support pallet 16 is secured rigidly to an outer portion of the arm, in accurate alignment and registration relative to the machine arm. The securement may be by welding or fasteners (not shown), etc. A receiver 18 is secured to the arm in spaced relation to the work support pallet by a clamp plate 20 disposed on the upper side of the arm and secured by threaded fasteners extending through openings in the plate on opposite sides of the arm and into threaded openings in the receiver disposed beneath the arm, as shown, the clamp plate 20 and an upper plate portion of receiver 18 comprising retainer plates.

A pallet tool 22 has upper longitudinal beams 24 extending through and secured to a plurality of cross members 26, and lower longitudinal members 28 similarly extending through openings in and secured to the cross members, as shown.

Other openings in the cross members serve to reduce the weight of the pallet tool. A rigid, accurate box construction is thus provided. A relatively thin registration member or frame 30 is secured atop the upper longitudinal beams 24 and has extending portions 32 from which two registration pins 34 extend upwardly. A third registration pin extends upwardly from a side portion of the upper registration member. Other registration means than pins and cooperating openings may be utilized.

Figure 2:
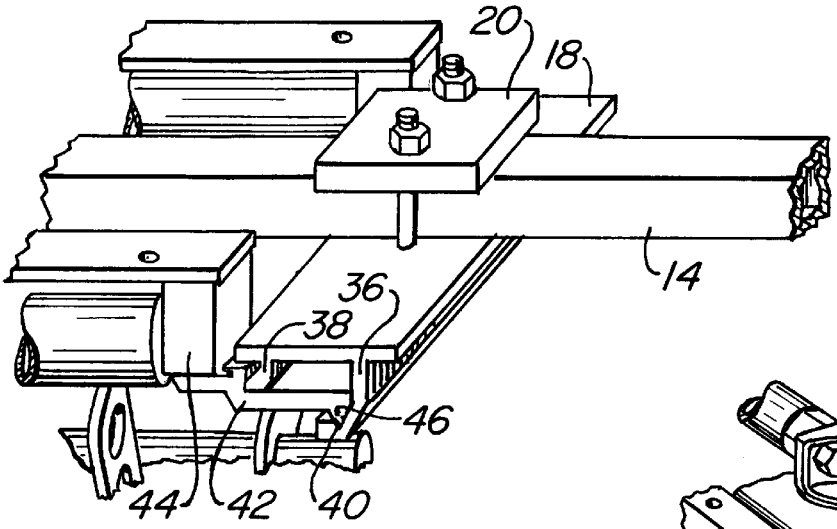
FIG. 2 is an enlarged perspective view showing the pallet tool wedge engaged in the bracket groove.

The receiver 18 has downwardly extending arms 36, 38, arm 36 being a first pivot component, as best shown in FIG. 2. A groove 40 of V-shape cross-section is defined in the outer portion transversely of the arm 36.

Extending from the pallet tool 22 is a second pivot component as wedge member 42 mounted on a block 44 secured to an end portion of registration member 30, as by welding. A transverse wedge 46 at the outer portion of the wedge member is adapted to engage and be rotated pivotally in groove 40. An alternative arrangement (not shown) would have the pivot arrangement disposed at or associated with the work support pallet.

The work support pallet is used in the registration of screen frames. To register a work support pallet with a screen frame, the pallet tool 29 is quickly positioned with the wedge 46 in groove 40, of member 42, by tilting the pallet tool upwardly and urging the wedge into the groove.

Figure 3:
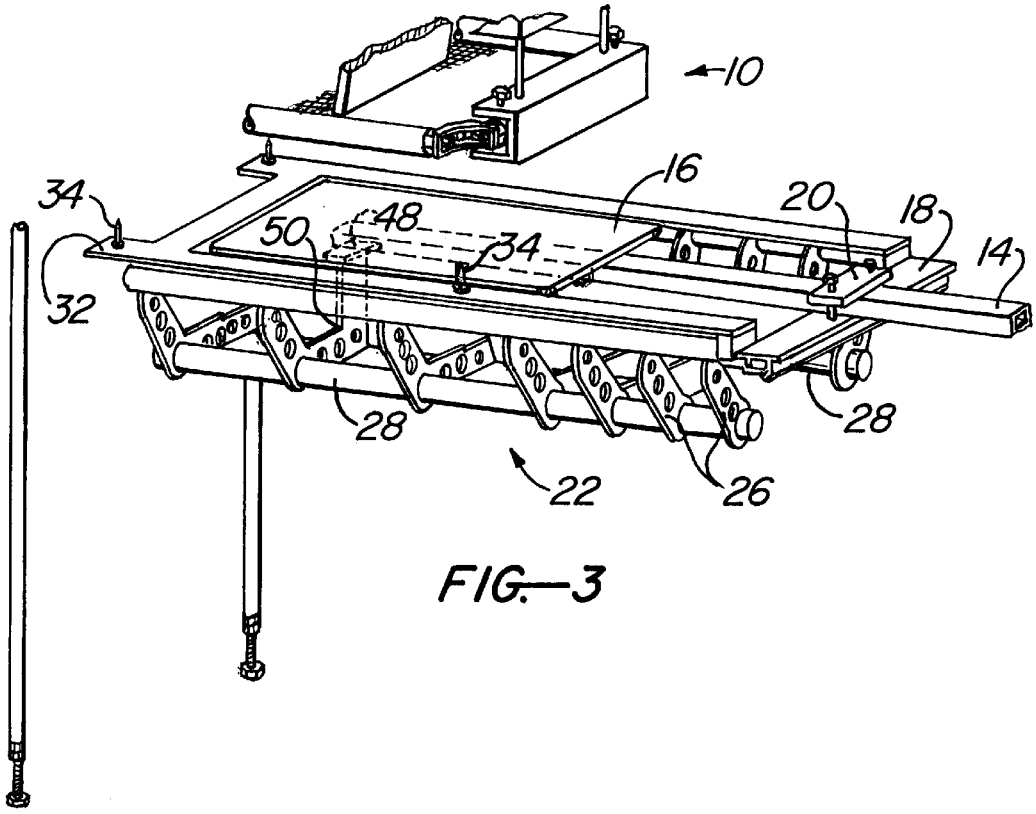
FIG. 3 is a partial perspective view showing the pallet tool of FIG. 1 pivoted to a position underlying the silkscreen frame of a printing station of a carousel machine.

The pallet tool is then pivoted upward about wedge 46 in groove 40 (FIG. 1) into position wherein the pallet tool is disposed beneath the work support pallet (FIG. 3). The work support pallet is then attached to the pallet tool by engagement of a magnet 48 on the lower side of the work support pallet with a magnet 50 on the upper surface of the pallet tool. Instead of magnets, other attachment devices such as thumb screws or latch arrangements may be utilized.

Figure 4:
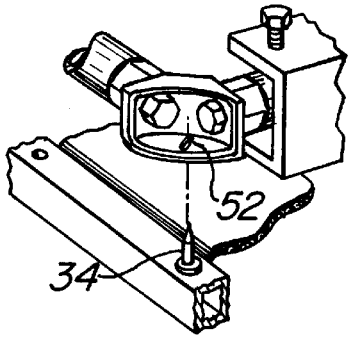
FIG. 4 is a fragmentary perspective view showing a pin on the pallet tool in relation to a cooperating registration opening at a corner of the screen frame of FIG. 1.

The registration of the work support pallet with the screen frame 10 is accomplished by inserting the registration pins 34 on the pallet tool, which are preferably spring loaded, into registration openings 52 in the screen frame corner structures, as indicated in the partial view of FIG. 4.

After registration and printing on a workpiece on the work support pallet, the work support pallet is readily removable by tilting the pallet tool downwardly and pulling it outwardly.

The procedure is repeated at each successive screen frame. At each successive screen frame station the screen frame is registered with the pallet tool so that the screen frames will all print in registration with each other on a workpiece, with successive images registering with each other.

The work support pallet is thus accurately registrable with each screen frame at successive stations of the printing machine, thus ensuring successive registered images on each workpiece.

Thus there has been shown and described a registration system for work support pallets and screen frames of printing machines which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

The Inventors claim:

1. Apparatus for registering a work support pallet on an arm of a carousel printing machine with screen frames associated therewith, comprising:

a pallet tool having a first pivot component to cooperate with a second pivot component disposed on said arm for detachably pivotally mounting the pallet tool relative to the arm for accurate pivotal movement of the pallet tool relative to the arm into proximity with the screen frame, and cooperating registration features on the pallet tool and on the screen frame to register the screen frame relative to the work support pallet.

2. Apparatus according to claim 1, wherein:

the registration features on the pallet tool comprise registration pins extending from at least two corners of the pallet tool, and the registration features on the screen frame comprise registration openings at at least two corners of the screen frame to receive the pins.

3. Apparatus according to claim 2, wherein:

the registration pins extend from three corners of the pallet tool, and three registration openings are defined at corners of the screen frame to receive the pins.

4. Apparatus for registering work support pallets on respective extending support arms of a carousel printing machine having associated screen frames for the imprinting of registering images on workpieces on work support pallets on respective support arms, the apparatus comprising:

a work support pallet mounted on one of said support arms of the machine, a bracket mounted on the arm and defining a groove transversely of the arm, a pallet tool having a wedge portion adapted to removably engage said bracket groove to detachably engage the pallet tool relative to the machine arm for pivotal movement into position for alignment with the screen frame, and registration features on the work support pallet for cooperation with registration features on the screen frame for registering the work support pallet with the screen frame.

5. Apparatus according to claim 4, wherein:

said bracket is secured to the machine arm below and transversely of the arm, and said pallet tool wedge portion is configurated and adapted for accurate removable engagement in said groove, whereby the pallet tool is pivotally accurately movable relative to said bracket means for pivotal movement of the pallet tool relative to the arm and into proximity with the work support pallet.

6. Apparatus according to claim 5, wherein:

the bracket is secured to the arm by threaded fasteners extending through openings in retaining plates on upper and lower sides of the arm and secured by retaining nuts.

7. A method of registering a work support pallet on a support arm of a carousel printing machine with a stationary screen frame, comprising:

providing a pallet tool, detachably the pallet tool relative to the support arm for pivotal movement into position in underlying relation with the work support pallet, positioning the pallet tool and the work support pallet in proximity with the screen frame, registering the pallet tool with the screen frame by engaging cooperating registration features on the pallet tool and on the screen frame, and securing the screen frame in its registration position.

8. A method of registering stationary screen frames with work support pallets on associated support arms of a carousel printing machine, comprising:

providing a pallet tool, mounting the pallet tool on a support arm, providing a work support pallet adapted for registration with the screen frame, engaging the pallet tool relative to the support arm for pivotal movement relative to the support arm into position underlying the work support pallet and the screen frame, and engaging registration features on the work support pallet with cooperating registration features on the screen frame to register the screen frame for accurate imprinting on a workpiece on the work support pallet.

9. A method according to claim 8, and further comprising the steps of:

detaching the pallet tool from the arm, and detachably mounting the pallet tool to successive arms for alignment with a succession of work support pallets on respective machine arms to register the work support pallet with the successive screen frames for imprinting successive overlying images by successive screen frames.

* * * * *

UNITED STATES PATENT AND TRADEMARK OFFICE

CERTIFICATE OF CORRECTION

PATENT NO. : 5,974,962

DATED : Nov. 2, 1999

INVENTOR(S) : HAMU, Kaino J. et al

It is certified that error appears in the above-identified patent and that said Letters Patent is hereby corrected as shown below:

Column 4, line 30, delete "detachably" and insert -- mounting -- .

Signed and Sealed this

Twenty-second Day of May, 2001

Nicholas P. Godici

*Attest:*

NICHOLAS P. GODICI

*Attesting Officer*

*Acting Director of the United States Patent and Trademark Office*